United States Patent [19]

Valentine

[11] 4,043,380

[45] Aug. 23, 1977

[54] PRODUCTION OF PLASTER MOLDS BY MICROWAVE TREATMENT

[75] Inventor: James M. Valentine, Vandalia, Ohio

[73] Assignee: Valentine Match Plate Company, Vandalia, Ohio

[21] Appl. No.: 609,617

[22] Filed: Sept. 2, 1975

Related U.S. Application Data

[63] Continuation-in-part of Ser. No. 419,580, Nov. 28, 1973, abandoned, which is a continuation-in-part of Ser. No. 253,204, May 15, 1972, abandoned.

[51] Int. Cl.[2] ..... B22C 9/12

[52] U.S. Cl. ..... 164/41; 164/6; 164/15; 164/250; 264/25

[58] Field of Search ..... 164/6, 15, 41, 50, 250, 164/43, 39; 264/25; 425/174.4, 174

[56] References Cited

U.S. PATENT DOCUMENTS

| | | | |
|---|---|---|---|
| 813,605 | 2/1906 | Weyer | 164/41 |
| 3,704,523 | 12/1972 | Guerga et al. | 264/25 X |
| 3,732,048 | 5/1973 | Guerga et al. | 264/25 X |

FOREIGN PATENT DOCUMENTS

| | | | |
|---|---|---|---|
| 1,332,512 | 12/1964 | France | 164/50 |

*Primary Examiner*—Ronald J. Shore
*Assistant Examiner*—Gus T. Hampilos
*Attorney, Agent, or Firm*—Biebel, French & Nauman

[57] ABSTRACT

Metal casting components, e.g. molds and cores, are produced from a compacted mass of plaster by a two-stage drying treatment in a microwave oven with an intermediate cooling step whereby the plaster is completely calcined, and the resulting component will promote cast reproduction of its surface pattern with maximum fidelity of detail.

7 Claims, No Drawings

PRODUCTION OF PLASTER MOLDS BY MICROWAVE TREATMENT

CROSS-REFERENCE TO RELATED APPLICATIONS

This application is a continuation in part of my application Ser. No. 419,580 filed Nov. 28, 1973, now abandoned, which is a continuation in part of my application Ser. No. 253,204 May 15, 1972 and now abandoned.

BACKGROUND OF THE INVENTION

It has been common practice for some time in the foundry industry to fabricate molds and cores, for use in casting metal parts, from commercial metal casting "plaster" which is a blend commonly comprising at least 50% gypsum plaster with the balance being primarily fibrous talc and some silica sand. In use, this plaster is mixed with a large amount of water, for example an equal or greater amount of water, to produce a highly fluid suspension which is capable of completely filling even relatively complex patterns in the master mold or pattern. Then this larger amount of water must be substantially completely eliminated, because any water which remains in the plaster can spoil a casting made therefrom, when it turns to steam upon contact with the molten metal, either by producing surface defects or by virtually exploding portions of the mold.

Drying of a plaster casting component by conventional methods is tedious and of unpredictable reliability in results, particularly if the component is complex or of substantial mass. One reason for these difficulties is that the gypsum component of the plaster normally retains a significant amount of water of crystalization, which cannot be eliminated without heating the entire component to a temperature greater than its calcining temperature of 270° F. This is a very time-consuming operation with a conventional baking furnance, which can easily require as much as 30 hours at 300° F, and even then, the probabilities are that a substantial proportion of a given plurality of components will crack or craze sufficiently to be unusable.

Attempts have been made to dry plaster casting components by exposure to microwave radiation in a microwave oven, on the premise that the known absorption capabilities of water for microwave radiation should make microwave heating an effective drying procedure for the plaster. Strangely, however, these attempts have not been successful, even when the mold or core is heated far beyond the normal 300° temperature obtained in a conventional oven, for example even as high as 600° F. While a mold or core dried in this manner appears to be completely dry, when it is then used for casting, sufficient additional water is given off by the plaster to spoil the majority of the castings. Additionally, heating to such high temperature ranges will usually cause cracks or crazing in a significant portion of the components which make them useless for casting purposes.

SUMMARY OF THE INVENTION

In accordance with the present invention, it has been discovered that casting components formed of commercial metal casting plaster can be dried very satisfactorily, very much more quickly than by conventional methods, and with minimal damage to the structure of the component itself and to its surfaces, if the wet-molded component is subjected to a two-stage microwave radiation treatment with an intermediate cooling step. More specifically, it appears that the water is effectively eliminated, i.e. the casting component is completely calcined, without loss of its strength or surface characteristics, when the microwave treatment is carried out only until the internal temperature of the component slightly exceeds 300° F, followed by cooling to a temperature of not more than 200° F. and then by a further microwave treatment which raises the temperature throughout the component to about 300° F.

The success of this procedure apparently derives from the fact that during the first microwave treatment, the free water throughout the casting component is driven off, but while the water of crystalization in the central zones of the component is caused to migrate to the surface zones, it is not driven off because of the surface of the component is sufficiently cooled by evaporation, of the free water, and also by radiation of heat to the normally cold walls of a microwave oven, to prevent the surface temperature from reaching the calcining range except after such prolonged treatment and resultant high internal temperature as will "dead burn"- or destroy the strength of the plaster of the central zones of the component. The second microwave treatment after cooling causes the water to be driven off from the surface zones of the component before the surface has been cooled by evaporation, and also before the central zones of the component can be reheated to the point of damage.

It is important in carrying out the method of the invention that the casting component be exposed for free evaporation from as much of its surface as possible. In particular, in the case of a multiple-part mold, the parts should be open, rather than closed, during the first microwave treatment. Otherwise there is a tendency for the surface zones of the mold parts which define the cavity to become calcined while water remains in the exposed surface zones, and then causes permanent warping. But if such a multiple-part mold is treated while open, and therefore with the cavity defining areas exposed, the process is successful as summarized below.

The significant result is that when a plaster casting component has been treated by microwave radiation as outlined above, it produces a perfect casting, free of the defects which commonly result from an incompletely dried plaster mold or core. Further, this advantageous result in obtained with the additional benefit that the time required is a minor fraction of the time necessary when a conventional baking oven is used. An even moreimportant advantage is that plaster molds have been produced in this manner in much greater sizes and with much higher fidelity as to reproduction of detail than has previously been possible using conventional drying methods, with the further outstanding advantage that such molds have been produced with substantial freedom from the cracking and surface crazing which are common disadvantages of conventionally dried plaster molds.

It is important to the understanding and appreciation of the invention to recognize that it relates to the production of molds and cores to be used in the casting of metal parts, and not to the production of the parts themselves or to the production of plaster or ceramic parts. In other words, the significance of the invention lies in the fidelity of detail which it promotes in a mold or core which is to be reproduced in the final part, and especially in the protection it provides against damage to the mold, and therefore also to the casting, which can occur when a mold or core is not adequately dried and retained water vaporizes in contact with hot casting metal and thus damages surface detail in the final casting. It is also of importance to this feature of fidelity of surface detail in mole components produced by the invention that the strength of the components is not impaired in the manner caused by the prolonged heating otherwise needed to effect comparably through drying.

DESCRIPTION OF THE PREFERRED EMBODIMENT

An example of the type of product for which the invention offers special advantages is a plaster mold from which to make metal castings which will in turn be used to produce plastic parts or sheet material having intricate surface pattern characteristics, such as wood grain or the appearance of leather or fabric. Such plaster molds are desirably of relatively large size to provide correspondingly large working areas, and they are extremely difficult to produce by conventional methods because of the tendencies of large plaster molds to crack or craze during conventional drying treatment.

In the practice of the invention, molds of such characteristics are produced by the following steps:

1. Prepared a mold pattern having the desired surface texture to be produced, as by lining the bottom of the cavity with a wood grained pattern whose surface is to be reproduced;
2. Spray the surface of the pattern lightly with an oil or other conventional release agent:
3. Fill the mold cavity with proper mixture of water and plaster, preferably using 40–50% dry plaster blend and 50–60% water;
4. Allow the plaster to set, which normally requires only about ten minutes;
5. Remove the set plaster mold mass from the mold cavity and place it in a microwave oven;
6. Apply microwave radiation until the internal temperature of the mass is in the range of 300°–320° F;
7. Discontinue heating and allow the mold mass to cool until its internal temperature is about 200° or less;
8. Reapply microwave radiation until the internal temperature of the mold mass reaches approximately 300° ;
9. The mold is now ready to use for casting the metal part therefrom.

Plaster molds produced as outlined above have been found to possess all necessary strength characteristics as well as high fidelity of detailed reproduction of the original pattern surface, free of cracks, crazing, and other surface and structural defects. The time necessary to dry a plaster mold mass of a size requiring 30 hours in a conventional oven was only about 7 hours for the first heating step by microwave radiation, 1 hour for the cooling step, and 30 minutes for the second heating step. Specifically, the mold mass in this example measured 30 ×48 ×4 inches. In addition, when similar plaster molds are attempted to be produced by conventional heating treatments, the rate of failure by reason of cracking or crazing often exceeds 50%. It is also significant that when a similar plaster mold was subjected to a single microwave treatment by which its temperature was raised far above 320° F, e.g. 600°, it still retained an undesirable amount of water, and it also was wholly lacking in the necessary strength as compared with the product of the two-step heating treatment of the invention. While the times and temperatures specified above are not critical, they typify the preferred range, and there are also some temperature guidelines which should be observed. The first heating step should continue beyond the calcining temperature of gypsum, namely 270°, but is should not go as high as 400°, and the range of 300°–320° provides a safe margin as well as effective results. Similarly, the intermediate cooling steps should go well below 270°, and 200° provides safe margin for this purpose. Highly satisfactory control over the operation of the invention has been established by means of an infrared sensor arranged to read the temperature of the surface at the bottom of a cavity in the component being dried. This is readily done by providing a target hole in the side of the mass, e.g. 2–3 inches in diameter and 2 inches in depth in such position that the infrared detector can readily measure the temperature at the bottom of this hole.

While the method herein described constitutes a preferred embodiment of the invention, it is to be understood that the invention is not limited to this precise method, and that changes may be therein without departing from the scope of the invention.

I claim:

1. The method of fabricating, from gypsum-containing plaster, a foundry casting component which is to be used in casting a metal part from molten casting metal at a temperature above the boiling point of water, and from which the water must be substantially completely eliminated to prevent its turning to steam upon contact with the molten metal, which method comprises the steps of, a. forming a moldable suspension of the plaster and water,
b. molding a mass of said suspension into a predetermined configuration,
c. subjecting said molded mass to electromagnetic wave energy at microwave frequency until the internal temperature of said mass exceeds the calcining temperature of gypsum while exposing substantially all surface areas of said mass for free evaporation of water and passage of steam therefrom,
d. discontinuing said exposing step and cooling said mass until the internal temperature thereof is substantially less than said calcining temperature, and
e. again subjecting said mass to microwave energy until the internal temperature thereof exceeds said calcining temperature while exposing substantially all surface areas thereof for free evaporation of water and passage of steam therefrom.

2. The method defined in claim 1 wherein said calcining temperature is 270° F.

3. The method defined in claim 2 wherein said subjecting step (c) is continued until the internal temperature of said mass is in the range of approximately 300°–320° F.

4. The method defined in claim 1 wherein said cooling step is continued until the internal temperature of said mass is below 200° F.

5. The method defined in claim 1 wherein each of said subjecting steps is continued until the internal temperature of said mass exceeds approximately 300° F, and said cooling step is continued until the internal temperature of said mass is not more than approximately 200° F.

6. The method defined in claim 1 comprising the further step of controlling at least one of said subjecting steps (d) by measuring with infrared radiation the temperature of the surface of a cavity in said mass.

7. The method defined in claim 6 wherein said cavity is a blind hole in the outer surface of said mass.

* * * * *